US009138756B2

(12) United States Patent
Schroeder

(10) Patent No.: US 9,138,756 B2
(45) Date of Patent: Sep. 22, 2015

(54) SHOWERHEAD OR HAND SHOWER

(71) Applicant: Grohe AG, Hemer (DE)

(72) Inventor: Claudia Schroeder, Iserlohn (DE)

(73) Assignee: Grohe AG, Hemer (DE)

( * ) Notice: Subject to any disclaimer, the term of this patent is extended or adjusted under 35 U.S.C. 154(b) by 119 days.

(21) Appl. No.: 14/056,417

(22) Filed: Oct. 17, 2013

(65) Prior Publication Data

US 2014/0054391 A1 Feb. 27, 2014

Related U.S. Application Data

(63) Continuation of application No. PCT/EP2012/001560, filed on Apr. 11, 2012.

(30) Foreign Application Priority Data

Apr. 18, 2011 (DE) ..... 10 2011 017 428

(51) Int. Cl.
*B05B 1/18* (2006.01)
*B05B 1/16* (2006.01)

(52) U.S. Cl.
CPC ..... *B05B 1/185* (2013.01); *B05B 1/169* (2013.01); *B05B 1/1609* (2013.01); *B05B 1/18* (2013.01)

(58) Field of Classification Search
CPC ..... B05B 1/16; B05B 1/1609; B05B 1/1681; B05B 1/169; B05B 1/18; B05B 7/0425; B05B 1/185; E03C 1/0409; E03C 1/046
See application file for complete search history.

(56) References Cited

U.S. PATENT DOCUMENTS

| | | | | |
|---|---|---|---|---|
| 5,937,905 | A | 8/1999 | Santos | |
| 6,145,757 | A * | 11/2000 | Knapp | 239/443 |
| 2010/0155639 | A1 | 6/2010 | Zhou | |
| 2010/0237160 | A1 | 9/2010 | Miller et al. | |
| 2011/0215174 | A1 * | 9/2011 | Chen | 239/310 |

FOREIGN PATENT DOCUMENTS

| | | | |
|---|---|---|---|
| CN | 100 427 215 | C | 10/2008 |
| CN | 100 427 218 | C | 10/2008 |
| CN | 101462096 | A * | 6/2009 |
| DE | 36 37 470 | C2 | 4/1995 |
| DE | 10 2009 008 196 | A1 | 8/2010 |
| WO | WO 2007/026153 | A1 | 3/2007 |
| WO | WO 2009/006755 | A1 | 1/2009 |

* cited by examiner

*Primary Examiner* — Darren W Gorman
(74) *Attorney, Agent, or Firm* — Muncy, Geisler, Olds & Lowe, P.C.

(57) ABSTRACT

A showerhead or hand shower with spray outlet openings and "x" (x>1) valves that control the inflow of a fluid to the spray outlet openings, wherein each valve can be activated independently of the other valves and comprises a movable valve body by means of which at least a first and a second valve position are realized, and for each of the "x" valves, a pushbutton is arranged to control it, wherein a displacement of the associated valve body takes place upon actuation of one or more pushbuttons, a control element is provided via which, when the same pushbutton or the same pushbuttons are actuated, the position of the associated valve body in the second valve position is secured and/or all other valve bodies whose associated pushbutton is not actuated are reset to the first valve position.

23 Claims, 8 Drawing Sheets

SHOWERHEAD OR HAND SHOWER

This nonprovisional application is a continuation of International Application No. PCT/EP2012/001560, which was filed on Apr. 11, 2012, and which claims priority to German Patent Application No. DE 10 2011 017 428.1, which was filed in Germany on Apr. 18, 2011, and which are both herein incorporated by reference.

BACKGROUND OF THE INVENTION

1. Field of the Invention

The present invention relates to a showerhead or hand shower and to a method for selecting a spray type.

2. Description of the Background Art

Most showerheads or hand showers have showerhead plates or spray face plates with multiple spray types. To this end, two or more groups of different spray outlet openings that are supplied with water separately or together are customarily arranged in the spray face plates. Inflow to the spray outlet openings is regulated by means of valve devices.

An extremely wide variety of solutions for switching the water inflow from one spray type to another are known from the prior art. DE 10 2009 008 196 A1 discloses a hand shower with a changeover valve that has a valve closing body and a valve seat in the form of valve plates with ports. To activate a specific group of spray outlet openings, the valve closing body is rotated in opposition to the force of a compression spring by means of an actuating device using the principle of the ballpoint pen. In this design, each press of a pushbutton rotates the valve plate onward through a specific angle of rotation. Depending on the position of the valve plate, reaching a specific spray type necessitates switching through a different spray type and operating the pushbutton multiple times.

U.S. Pat. No. 5,937,905 discloses a showerhead with two spray patterns and a changeover device with two axially movable valve closing bodies that can be moved back and forth between a closed position and a flow position by means of a rocker switch. Depending on the position of the valve closing body, the access to a group of spray outlet openings is opened while the other access to the second flow pattern is simultaneously closed.

In addition, from US 2010/0237160 A1 is known a hand shower with multiple groups of spray outlet openings and multiple valves, wherein each valve is associated with a group of spray outlet openings. Each valve comprises an axially movable valve closing body that can be moved from a closed position to an open position by an actuation of a push-button, and back into the closed position by another actuation of the push-button. In this design, each individual valve can be controlled independently of the others. Depending on the valve position, however, all valves present in the hand shower may be in a closed position. For this reason, additional spray outlet openings are included that cannot be closed by the valves. This means that water is continuously dispensed from these spray outlet openings when water pressure is present. Consequently, these spray outlet openings are not controllable and function as a non-lockable spray.

SUMMARY OF THE INVENTION

It is therefore an object of the present invention to provide a showerhead or hand shower with multiple spray outlet openings and/or multiple spray types whose inflow can be controlled by means of valves.

In an embodiment, the invention provides a showerhead or hand shower with multiple spray outlet openings, with a number "x" (x>1) of valves that regulate the inflow of a fluid to the spray outlet openings, wherein each valve is arranged separately and each valve comprises a movable valve body by means of which at least two defined valve positions are realized. Examples of defined valve positions are the flow position and closed position of a valve. Different spray types can be realized through different spray outlet openings, for example. In the case of "x" valves, typically "x" different spray types or "x" different types of spray outlet opening are provided. For example, spray outlet openings can be provided for individual sprays, aerated sprays, massage sprays, or moving jets. These openings differ in their size and shape. All spray outlet openings in this context can be controlled by means of valves. For each of the "x" valves, a pushbutton is arranged to control it. Selection of a spray type and control of a valve is accomplished by actuating the pushbutton and thus actuating the associated valve body. In this way, each valve can be controlled independently of the others. When a pushbutton is actuated, the valve body is moved from the first valve position to the second valve position. When the same pushbutton or pushbuttons is/are actuated twice or repeatedly, the valve body of the associated valve remains in the second valve position. At the same time, all the remaining valve bodies whose associated pushbutton is not actuated are reset to the first valve position. This is accomplished in that the valve body is released from a lock position. The lock position and/or release position is defined here by the control element or the position of the control element. To this end, a valve body can, where appropriate, be moved into a third valve position in which the control element is positioned such that the valve bodies of the valves whose pushbuttons are not activated are released and return to the first valve position. As desired, each valve can be controlled individually, in combination with others, or all "x" valves at the same time. Furthermore, the resetting of "z" (z<x) valves from the second valve position to the first valve position is accomplished by actuating at least one pushbutton or by actuating "x−z" pushbuttons. The invention achieves the result that all spray types of a showerhead can be produced directly on their own, or also can be produced in combination with one another without it first being necessary to deselect another spray type. Thus, if all "x" pushbuttons are actuated and subsequently the desire is to select only one pushbutton or one valve, it suffices to press the desired pushbutton in order to retain the desired spray type. The remaining valves are automatically reset.

An embodiment of the invention provides for at least one additional valve can be arranged that is in operative combination with one of the "x" valves. This means that the additional valve is coupled to one of the "x" valves and can be controlled or actuated simultaneously with it through its associated pushbutton. For instance, the additional valve can be used to activate the delivery of air, a fragrance, or a body wash. In this context, the additional valve can be coupled to one of the "x" individually arranged valves through a rocker or a lever. In addition, it is possible to couple each of the "x" controllable valves to one or more additional valves.

Each of the valves comprises a valve seat that is arranged on a water passage of the showerhead or hand shower, and a movable valve body. The valve body can be one-piece or multi-piece. It has a first region that is provided for a sealing function, the so-called seal body, and a second region, the so-called tappet, which is provided for guiding the valve body. The tappet is mounted in a radially fixed and axially movable manner so that the valve body can be moved in the direction of its longitudinal axis. In addition, the valve body is spring mounted. The mounting can be implemented by means of a separate travel limiting spring or by means of a spring element that is part of the valve body. If the valve body is multi-piece in design, the tappet and seal body can be positioned axially relative to one another by means of pegs. In addition, the valves have a seal element in the form of a sealing ring that is provided on the valve body or on the valve seat.

The pushbuttons of the valves can be connected to the valve body in such a manner that the latter completes a certain motion when the pushbutton is actuated. The direction of motion of the pushbutton and valve body correspond here. When the pushbutton is actuated, the travel limiting spring or the spring element is compressed by means of the valve body. The resetting of the valve body out of the second valve position takes place because of the spring force of the so-called return spring.

An embodiment of the invention provides that each valve is in a closed position in the first valve position and is in a flow position in the second valve position. When the valve body is moved out of the first valve position into the second, this movement takes place in opposition to the force of the return spring.

A further embodiment of the invention additionally provides for multiple fluid distribution chambers to be provided in the showerhead and for the inflow of at least one fluid per fluid distribution chamber to be regulated by means of at least one valve, wherein each fluid distribution chamber is associated with one spray outlet opening or a certain number of spray outlet openings. The valves and valve seats are thus each located in the region of a specific fluid distribution chamber. Depending on the valve position, they permit the inflow of the fluid from a water passage to a fluid distribution chamber, or the inflow of air from an air intake passage to a fluid distribution chamber. Water can be supplied to the spray outlet openings through the fluid distribution chambers. In addition, it is also possible to supply both air and water to a fluid distribution chamber through the valves and to mix the two fluids in a fluid distribution chamber. Aerated sprays can subsequently be delivered through the spray outlet openings connected to this fluid distribution chamber.

An embodiment of the invention provides a control element that is suitable for guiding all "x" valve bodies. To this end, the valve bodies have a guide element that can be provided in the form of a peg or cone. The control element can be provided as a rotatable gate disc or a translationally movable gate slide, for example. In advantageous fashion, at least one gate for guiding at least one valve body is provided on the control element. When actuation of a valve and the associated movement of a valve body take place, a movement of the control element in opposition to the force of a return spring takes place at the same time. In addition, the control element serves as a locking element for the valve bodies in the applicable valve positions. To this end, one or more receptacles for each valve body are provided on the control element, which receptacles define the first or second valve position.

Because of the individual arrangement of the valves and the associated optional actuation, there are "$2^x-1$" possibilities for different spray types or combinations of spray types for the "x" valves and the associated "x" individual spray types.

In addition, the invention provides a method for selecting at least one spray type in a showerhead or hand shower with "x" ($x>1$) valves and with multiple spray types, in which at least one individually controllable valve is associated with each spray type. Each of the "x" valves here can be controlled independently of the other valves. In addition, each valve comprises a movable valve body by means of which at least a first and a second valve position are realized. For each of the "x" valves, a pushbutton is arranged to control it, wherein the displacement of the associated valve body takes place upon actuation of one or more pushbuttons. In advantageous fashion, when a number "y" ($y\leq x$) valves are activated, the associated valve bodies are moved out of a first valve position into a second valve position or remain in the second valve position, while at the same time for "x−y" valves the associated valve bodies remain in their first valve position or return to the first valve position. This means that when the same pushbutton or pushbuttons are actuated, the valve bodies of the associated valves remain in the second valve position and/or all other valve bodies whose associated pushbutton is not actuated return to the first valve position.

In a showerhead with different spray types, the method achieves the result that all spray types can be activated individually, in combination with one another, or all at once. At the same time, the valves that are not activated or whose pushbuttons are not actuated return to their closed position. If all pushbuttons are depressed, one pushbutton can be selected and actuated again. In this case, the valve body of the valve associated with this pushbutton can be brought into a third valve position. The valve bodies of the non-actuated pushbuttons or associated valves again return to the first valve position. Furthermore, the result is achieved that the valves are never all in the closed position at any given time, since the shutoff of the inflow of water for the showerhead must be accomplished by means of a shutoff valve at a fitting connected to the showerhead.

In each case, selection of the spray type is accomplished by activation of the valves, in that the associated valve bodies are actuated. Moreover, activation of the valves takes place through actuation of the pushbuttons that are connected to the valve body.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus, are not limitive of the present invention, and wherein.

DETAILED DESCRIPTION

Figure 1:
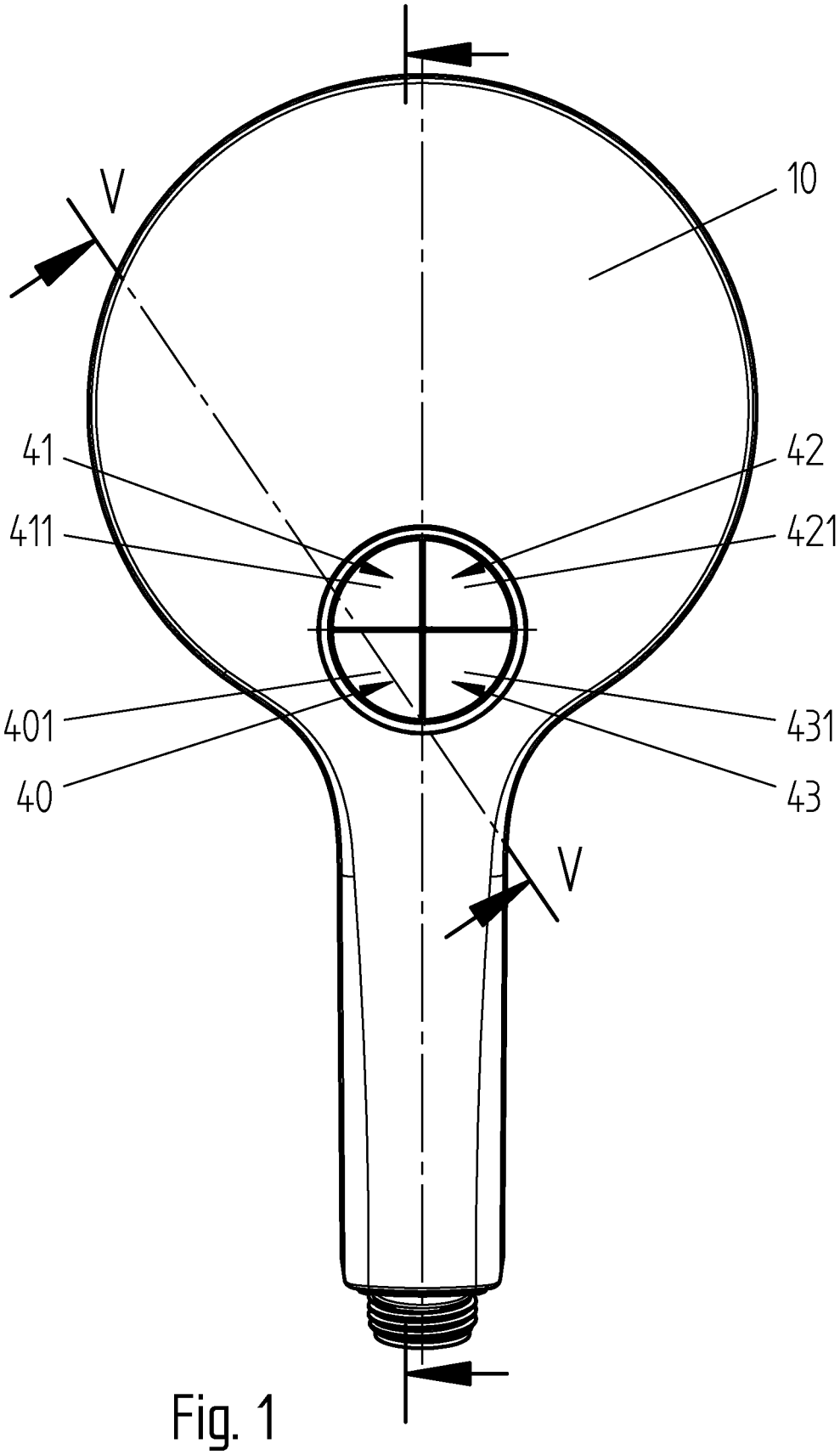
FIG. 1 is a top view of a hand shower according to the invention.

FIG. 1 shows a top view of a hand shower according to the invention. Arranged on the top side thereof are four pushbuttons 401, 411, 421, 431 that are provided for actuating at least four valves 40, 41, 42, 43. In the present example embodiment, the pushbuttons 401, 411, 421, 431 have the shape of a segment of a circle, and in their arrangement produce a circular operating panel. Customarily the pushbuttons 401, 411, 421, 431 are labeled with a symbol or lettering that indicates the spray type that can be selected. In addition, the pushbuttons 401, 411, 421, 431 are arranged in a region of a housing 10 that allows the user convenient actuation of the pushbuttons 401, 411, 421, 431 when he is holding the showerhead in his hand.

In the present example embodiment, four individual spray types are provided. In addition, three different types of spray outlet openings 50 are provided. An individual spray type can be selected by actuating a single pushbutton 401, 411, 421, 431. In this design, it is possible to choose between a normal spray with a plurality of individual sprays, an aerated spray, a hard spray with a large spray diameter, and a massage spray with a movable spray pattern. Since it is also possible to actuate all pushbuttons 401, 411, 421, 431 simultaneously, a plurality of combinations of the different individual spray types is possible.

Figure 2:
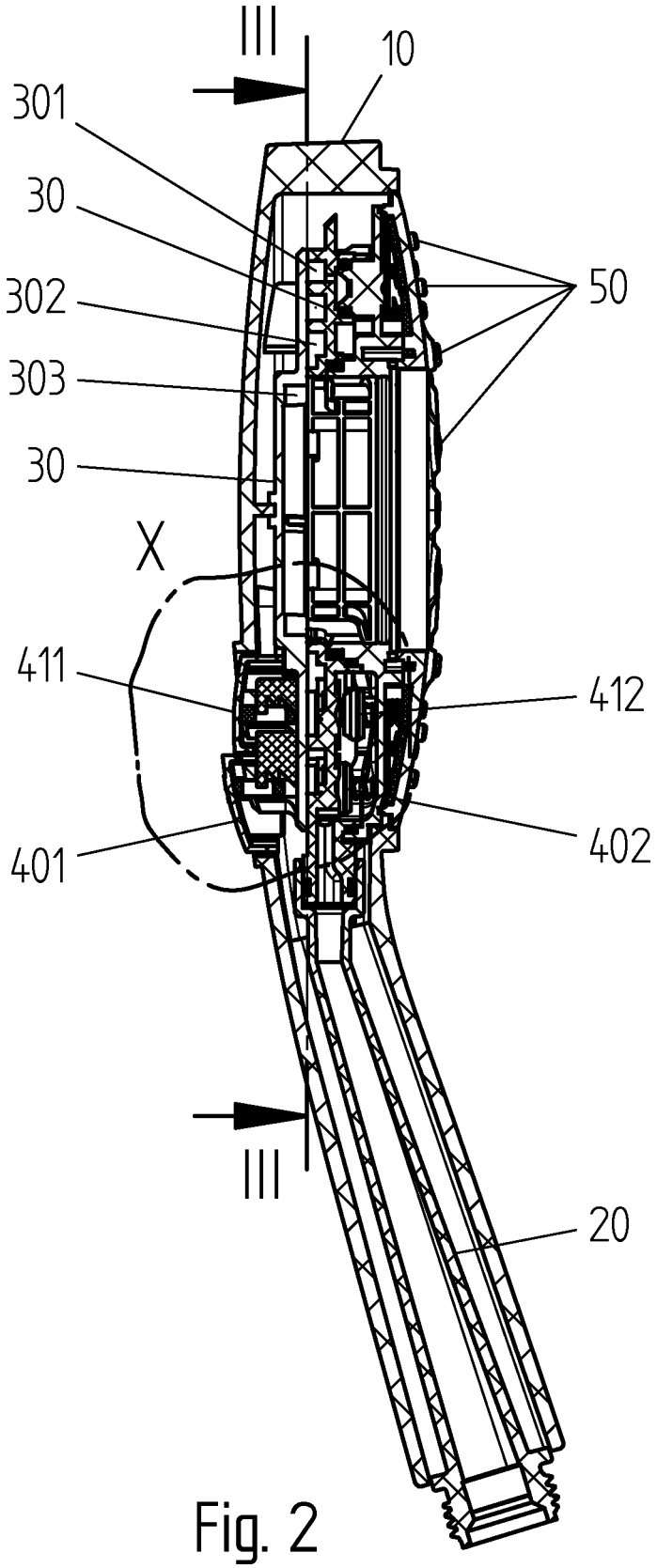
FIG. 2 is a section through the hand shower from FIG. 1.

The structure of the hand shower is evident from FIG. 2. Arranged in the housing 10 are a handle water passage 20 and a head water passage 30. The head water passage 30 contains multiple fluid distribution chambers 301, 302, 303, 304 and the associated valves 40, 41, 42, 43, 80 that control the inflow of at least one fluid per fluid distribution chamber 301, 302, 303, 304. In addition, multiple spray faceplate units that have different types of spray outlet openings 50 are arranged on the bottom of the head water passage 30. Each of the valves 40, 41, 42, 43, 80 includes a valve seat, which is located in the region of the inlets to the fluid distribution chambers 301, 302, 303, 304 on the head water passage 30. In addition, each valve 40, 41, 42, 43, 80 has a movable valve body 402, 412, 422, 432, 802, which includes a guide region, for example a tappet, and a sealing region, for example a seal body. In the present example embodiment, an annular seal element 403, 413, 423, 433 is arranged in the sealing region of each valve body 402, 412, 422, 432, 802. In addition, each of the valves 40, 41, 42, 43, 80 has a return spring 404, 414, 424, 434 that presses the valve body 402, 412, 422, 432, 802 against the relevant valve seat. This ensures that the valves 40, 41, 42, 43, 80 are leak-tight even when the water pressure in the water passage 20, 30 is low.

Figure 3:
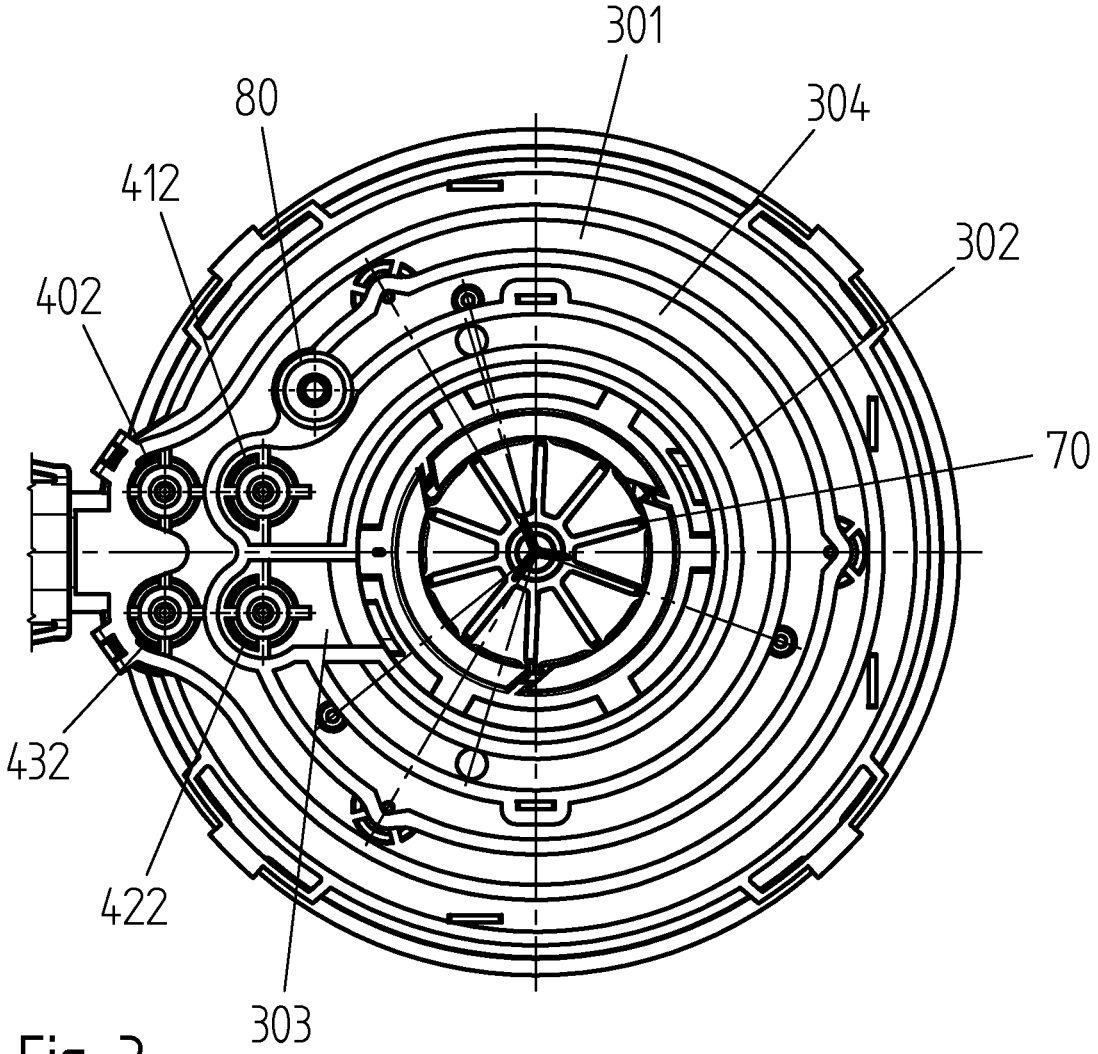
FIG. 3 is a section through the hand shower from FIG. 2 along the line III-III.

The arrangement of the fluid distribution chambers 301, 302, 303, 304 and their associated valves 40, 41, 42, 43 is clear from FIG. 3. In the present example embodiment, four fluid distribution chambers 301, 302, 303, 304 in all are provided, which are arranged to be largely concentric to the center point of the circular showerhead. A gear unit 70 that serves to produce a massage spray is located in the inner region of the showerhead. To this end, spray outlet openings 50 are provided on movably arranged spray nozzles. The gear unit 70 for driving the spray nozzles is supplied with water through the fluid distribution chamber 303. When the pushbutton 421 is actuated and depressed, the associated valve body 422 is displaced. This raises the valve body 422 from its valve seat and moves it in opposition to the force of a return spring 424. When this occurs, the inflow of water from the water passage 20, 30 into the fluid distribution chamber 303 is enabled.

The inflow to the fluid distribution chamber 302 is controlled through the pushbutton 411 and the associated valve 41 or the associated valve body 412. The fluid distribution chamber 302 stands in connection with spray outlet openings 50 that produce a spray with fairly large spray diameter, a so-called "jet" spray. Inflow to the fluid distribution chamber 301 is controlled through the valves 40, 43 and the associated pushbuttons 401, 431. When the pushbutton 431 is actuated, only the valve body 432 is moved to a flow position. When this occurs, the inflow of water to the fluid distribution chamber 301 is enabled. In this valve position, a normal spray with a plurality of individual sprays is produced by the spray outlet openings 50.

Figure 5:
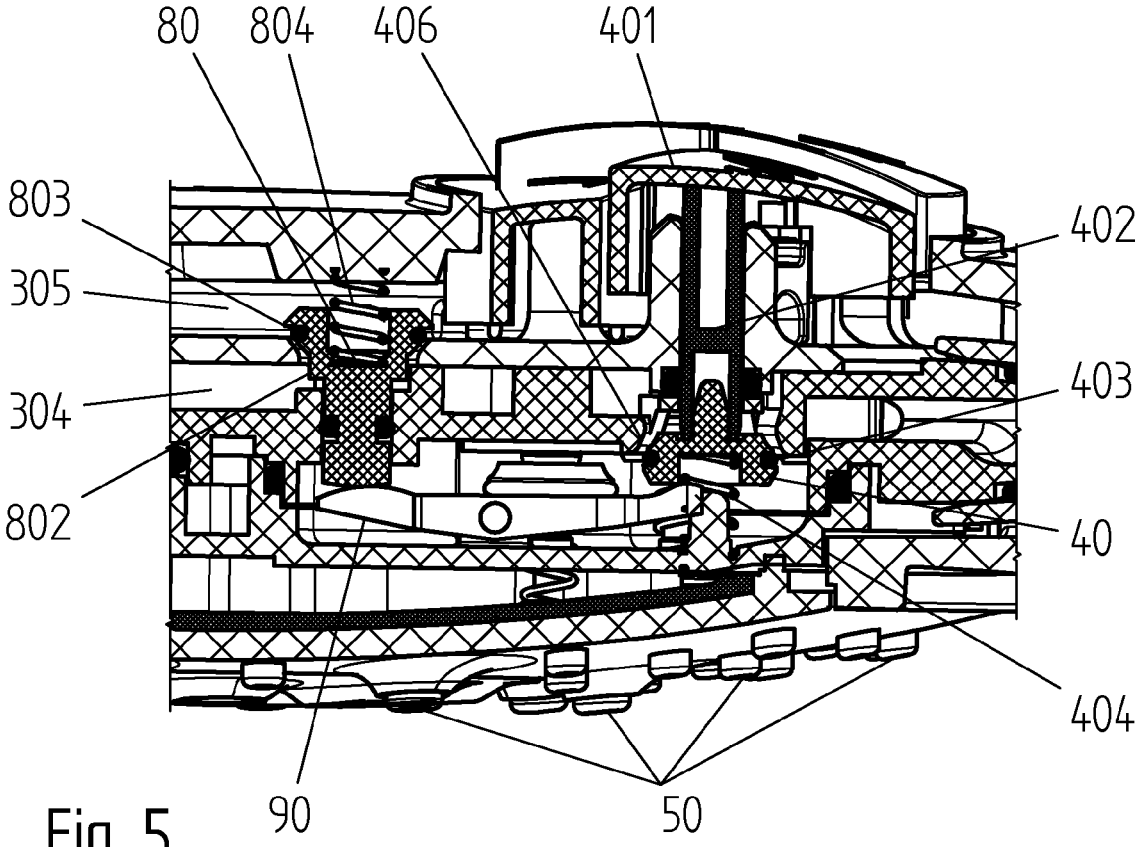
FIG. 5 is a detail view of a section through the hand shower from FIG. 2 along the line V-V.

It is evident from FIG. 5 that the valve 40 is also coupled to an additional valve 80. This valve is connected to the valve 40 by a lever 90. When the pushbutton 401 is actuated, the associated valve body 402, which is implemented in a two-piece design here, is displaced from its valve seat 406 to a flow position for the water so that the water can flow into the fluid distribution chamber 301. The valve body 402 includes a tappet and a seal body on which the seal element 403 is arranged. When the valve body 402 is displaced, it presses on one end of the lever 90, the other end of which acts on the valve body 802 and the spring 804, and raises the valve body 802 from its valve seat 803 as well. While the valve body 402 is moved downward by the pushbutton 401, the valve body 802 of the valve 80 is moved upward at the same time. This releases an opening to the fluid distribution chamber 304, which is an air distribution chamber that stands in connection with an air intake passage 305. The fluid distribution chambers 301 and 304 are arranged such that air can flow out of the fluid distribution chamber 304 and water can flow out of the fluid distribution chamber 301 into the mixing chamber located thereunder when the valve body 802 is moved into a flow position. In this valve position, an aerated shower spray is produced. The water exits the fluid distribution chamber 301 through the same spray outlet nozzles 50 as when the valve 43 is actuated. However, a visibly different spray, and thus a different spray type, is produced through the admixture of air.

The showerhead according to the invention makes it possible to select the spray types specifically and directly by actuating the relevant pushbuttons 401, 411, 421, 431. It is possible here to press the pushbuttons 401, 411, 421, 431 individually or in combination with one another. It is also possible to actuate all pushbuttons 401, 411, 421, 431 at once. The advantage of the invention is that an existing spray type or combination need not be deselected before it is possible to select a new spray type. Instead, the existing selection is automatically deselected when a new spray type is selected by actuating one or more pushbuttons. This is accomplished by means of a control element 60 that serves to guide the valve bodies 402, 412, 422, 432. To this end, the valves 40, 41, 42, 43 have a guide element 405, 415, 425, 435.

The mode of operation is explained in detail using FIGS. 4*a* through 4*d*. The control element 60 is arranged between or on the valves 40, 41, 42, 43 such that it is always in contact with all guide elements 405, 415, 425, 435 in some form. The control element 60 is provided in the form of a one-piece, movable gate disc which must be moved in opposition to the force of a return spring during a motion. The direction of motion of the control element 60 is perpendicular to the direction of motion of the valve bodies 402, 412, 422, 432.

Figure 4A:
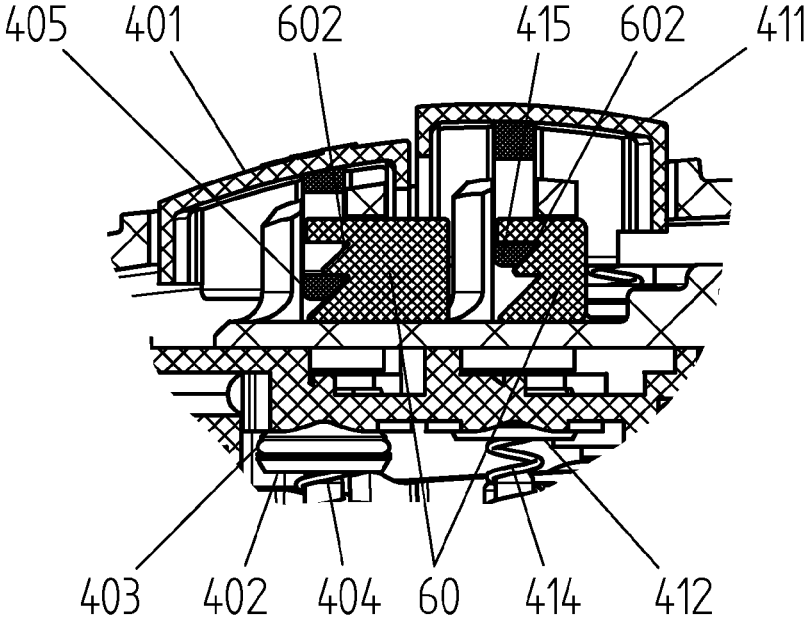
FIG. 4*a* illustrates a detail "X" from FIG. 2.

In FIG. 4*a*, the pushbutton 411 of the valve 41 is in a non-actuated position. The associated valve body 412 is in the first valve position, which corresponds here to the closed position of the valve 41. The seal element 413 of the valve body 412 rests against the valve seat. Inflow to the fluid distribution chamber 302 is thus blocked. A guide element 405 in the form of a peg is provided on the valve body 412 perpendicular to the valve body axis. The guide element 405 has a trapezoidal cross-section. In the depicted first valve position of the valve 41, the guide element 415 is located in a first receptacle 602 of the control element 60. Because of the geometry of the guide element 415 and receptacle 602, the valve body 412 and the pushbutton 405 connected thereto are secured in this first valve position even though the return spring 414 presses against the valve body 412, since the control element 60 is mounted so as to be immovable in the direction of the valve travel. In contrast thereto, the pushbutton 401 is in an actuated position, so that the associated valve 40 is activated and is in the flow position. The associated valve body 402 is thus in the second valve position and rests in a receptacle 603 of the control element.

Figure 4B:
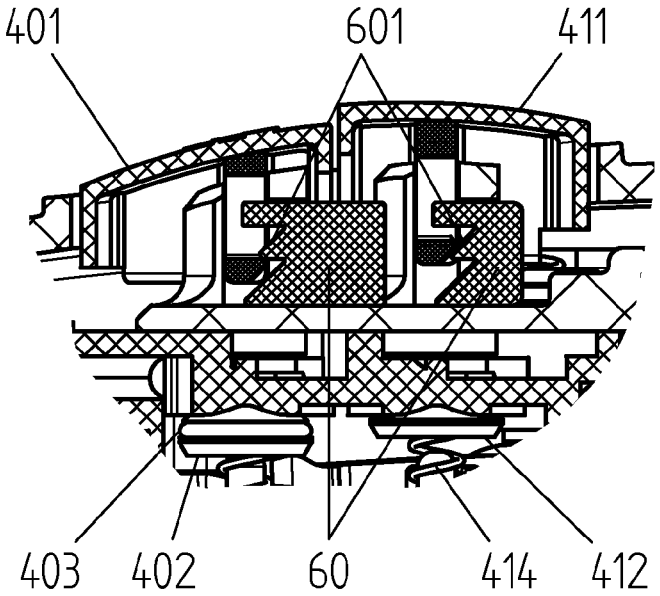
FIG. 4*b* illustrates the detail "X" from FIG. 2 with different pushbutton and valve positions.

In contrast thereto, in FIG. 4*b* the pushbutton 411 is currently in a non-secured position. The pushbutton 411 of the valve 41 is currently being actuated and pushed downward. In this process, a beveled edge of the guide element 415 slides along a gate 601 of the control element 60, moving the control element 60 in opposition to the force of a return spring. If the pushbutton 411 is pushed further downward without the pushbutton 401 simultaneously being actuated as well, the control element is moved far enough so that the guide element 405 slides out of the receptacle 603. In this case, the valve body 402 would be pushed upward due to the restoring force of the return spring 404 until the guide element 405 reaches engagement with the receptacle 602. A further upward motion of the valve body 402 and the pushbutton 401 connected to it would then be blocked.

Figure 4C:
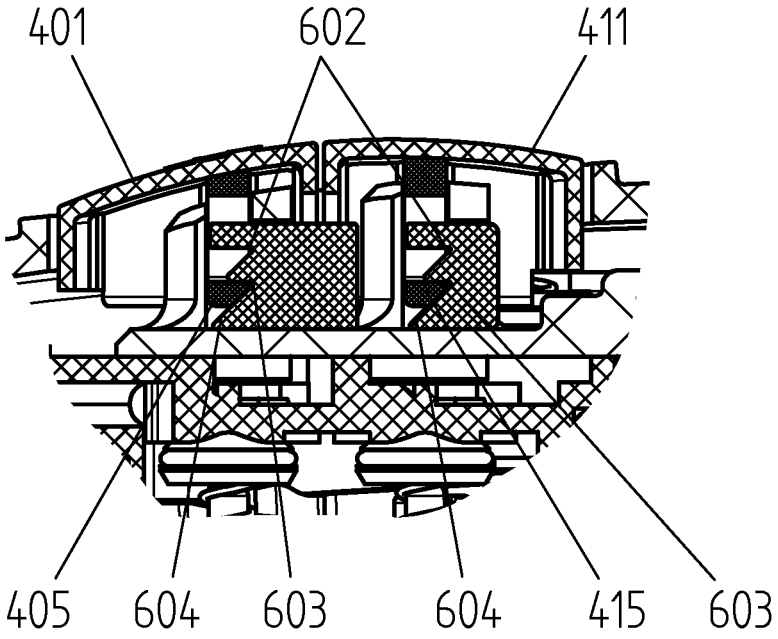
FIG. 4*c* illustrates the detail "X" from FIG. 2 with different pushbutton and valve positions.

In FIG. 4*c*, both valves 40, 41 are in the flow position. The associated valve bodies 402, 412 are in the second valve position and the associated guide elements are secured in the two receptacles 603 of the control element 60.

Figure 4D:
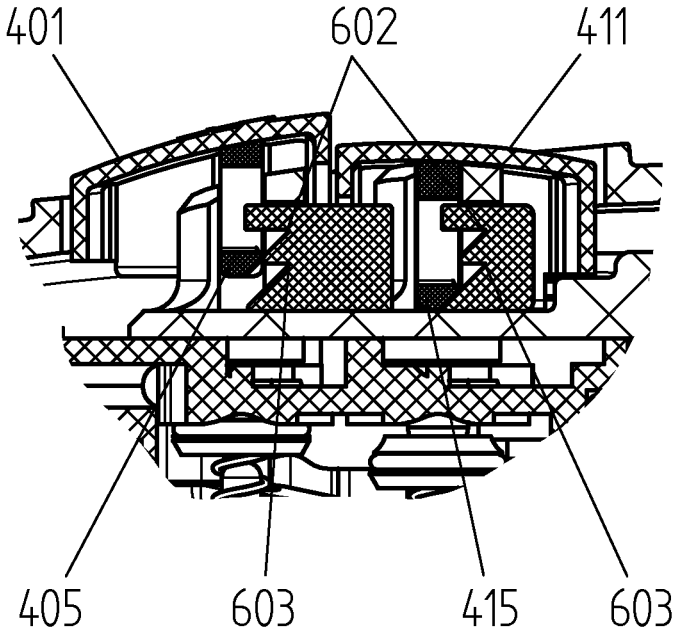
FIG. 4*d* illustrates the detail "X" from FIG. 2 with different pushbutton and valve positions.

In the hand shower according to the invention, it is possible to operate all four pushbuttons 401, 411, 421, 431 at the same time. In this situation, all valve bodies 402, 412, 422, 432 would be in the second valve position. Accordingly, then, all guide elements 405, 415, 425, 435 are secured in the associated receptacles 603 of the control element 60. FIG. 4*d* shows the situation when the spray type defined by the valve 41 is selected and the other valves are deselected by actuating the pushbutton 411.

The pushbutton 411 is pressed down to its stop position. When this occurs, the guide element 415 is also slid along the second gate 604 to a stop position. In this position, the control element 60 is also located in a stop position. Further displacement of the pushbutton 411, valve body 412, guide element 415, and control element 60 is no longer possible. However, the control element is now displaced far enough that the other guide element 405 or the guide elements 405, 425, 435 of all other non-actuated pushbuttons 401, 421, 431 are no longer in engagement with the control element 60 and are automatically moved upward. The resetting of the valve bodies 402, 422, 432 is in turn limited by an upper stop that is defined by the first receptacle 601 of the control element 60.

Another example embodiment that shows an alternative control element 60 is depicted in FIGS. 6*a*, 6*b*, 6*c*, and 6*d*. The control element 60 is implemented in the form of a rotatable gate disc. This, too, is rotated in opposition to the force of a return spring upon a movement of a valve body 402, 412, 422, 432. The guide elements 405, 415, 425, 435 of the valve bodies 402, 412, 422, 432 are shaped as cones at the upper end of the valve bodies 402, 412, 422, 432. The valve bodies 402, 412, 422, 432 each have a spring unit at the bottom end that acts as a return spring 404, 414, 424, 434. The gates 601 are implemented in the form of cutouts in the shape of segments of a circle with beveled surfaces or edges.

Figure 6A:
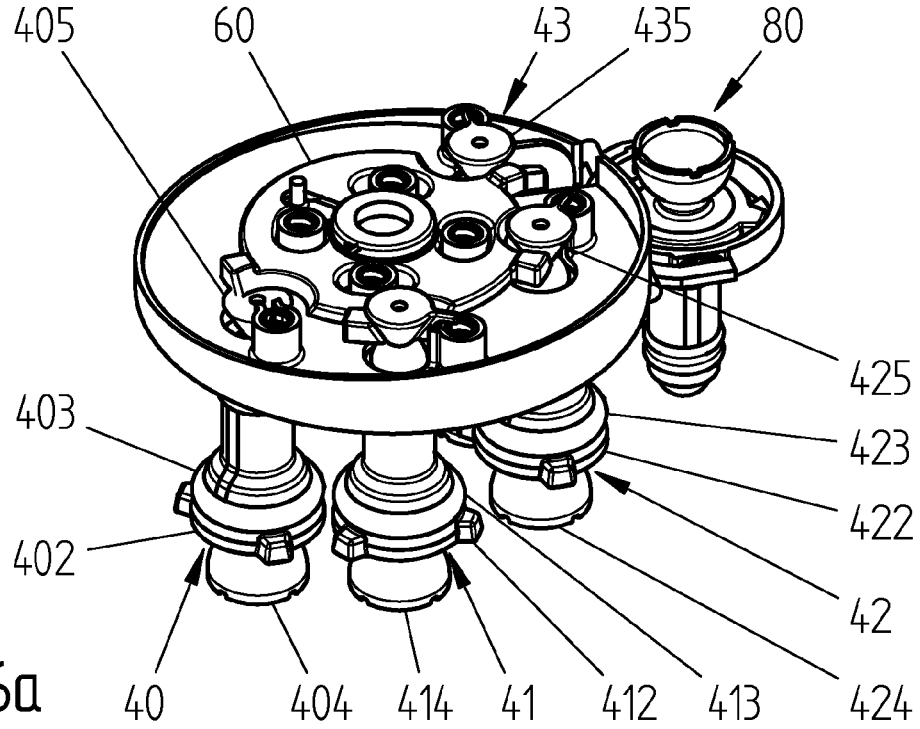
FIG. 6*a* is a perspective view of an alternative embodiment for a control element and associated valves.
Figure 6B:
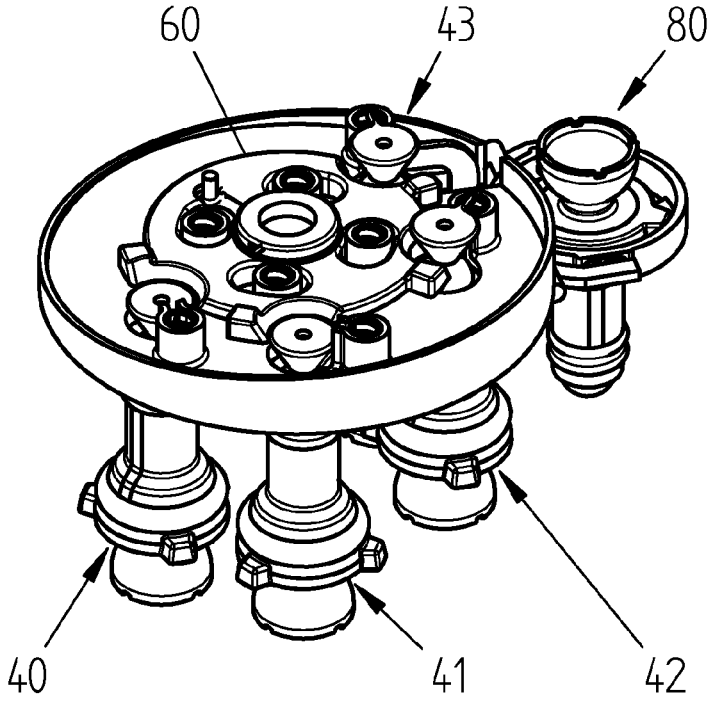
FIG. 6*b* is a perspective view from FIG. 6*a* with different valve position.
Figure 6C:
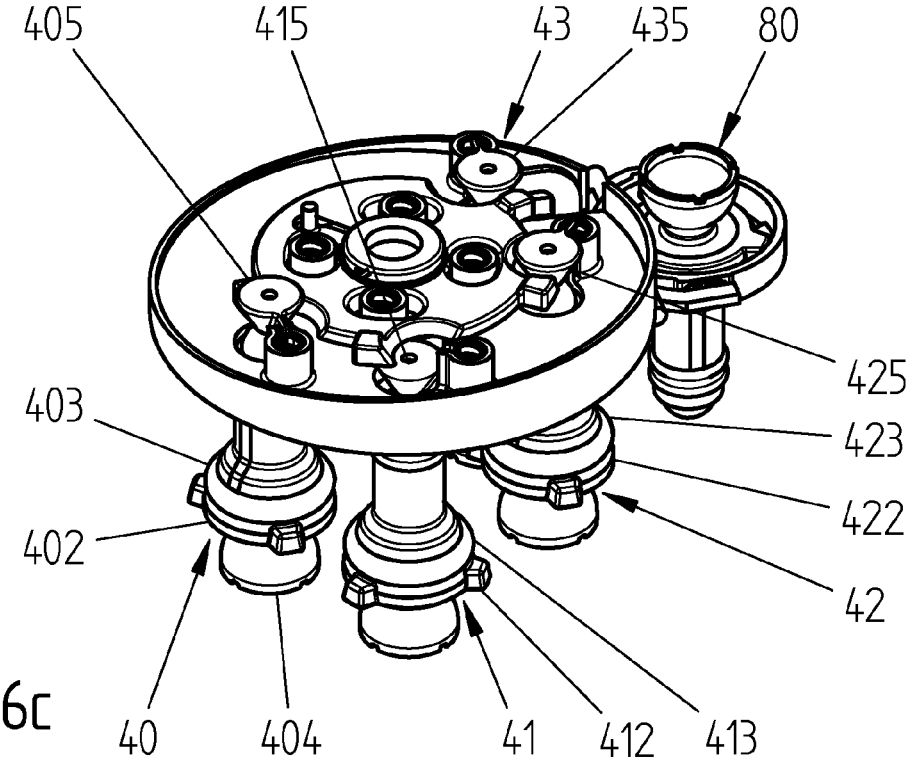
FIG. 6*c* is a perspective view from FIG. 6*a* with different valve position.
Figure 6D:
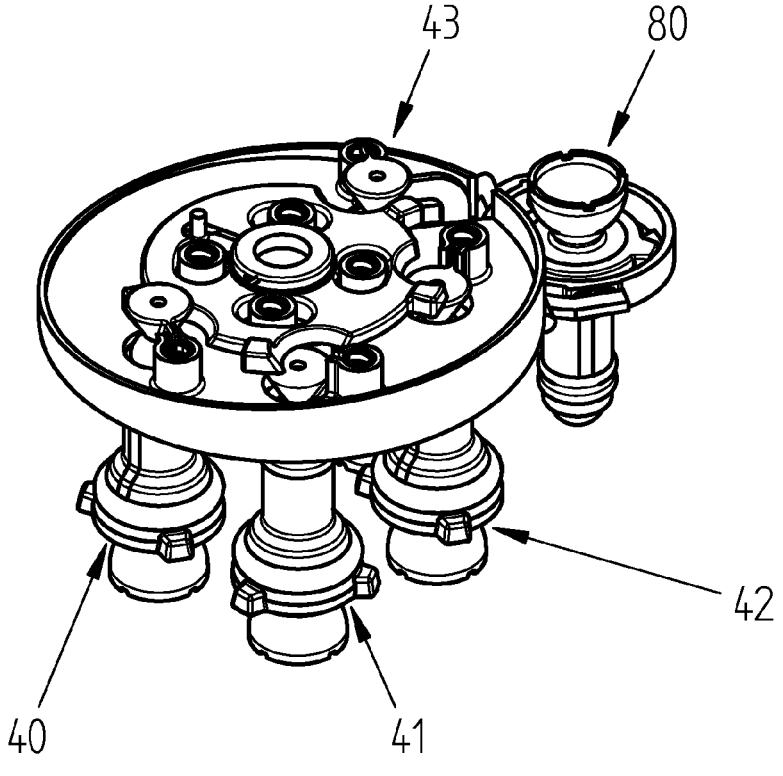
FIG. 6*d* is a perspective view from FIG. 6*a* with different valve position.

In FIG. 6*a*, the valve body 402 has been moved downward out of the first valve position into the second valve position through actuation of the associated pushbutton (not shown). During an actuation as shown in FIG. 6*b*, the guide element 405, 415 of the valve body 402, 412 slides along the gate 601 and in doing so moves the control element 60 by a specific angle of rotation. The cutout in the control element 60 in the shape of a segment of a circle is large enough that the guide element 405, 415, 425, 435 fits through it. Once the guide element 405, 415, 425, 435 arrives below the control element 60, the control element 60 rotates back because of the restoring force of the spring. As a result, the valve body 402, 412, 422, 432 is locked in the position below the control element 60 by the control element 60 itself. The resetting of the locked valve body 412 in FIG. 6*c* is accomplished by actuation of a different valve body 402, 422, 432 and the associated rotation of the control element 60. Once the corresponding recess reaches the position above the non-actuated valve body 412, the latter can return to the first valve position due to the restoring force of the spring.

In this embodiment, too, each valve 40, 41, 42, 43 can be activated directly and independently of the valve position of the remaining valves 41, 42, 43, 40. In this way, the spray types and combinations of spray types can be selected without prior deselection of the previously chosen spray type.

The invention being thus described, it will be obvious that the same may be varied in many ways. Such variations are not to be regarded as a departure from the spirit and scope of the invention, and all such modifications as would be obvious to one skilled in the art are to be included within the scope of the following claims.

What is claimed is:

1. A showerhead or hand shower comprising:

spray outlet openings;

a plurality of valves that control an inflow of a fluid to the spray outlet openings, each valve being configured to be activated independently of the other valves and each comprising a movable valve body via which at least a first and a second valve position are realized;

a pushbutton provided for each of the plurality of valves, each respective pushbutton being arranged to control a respective one of the plurality of valves, wherein a movement of a respective valve body takes place upon actuation of the respective pushbutton;

a movable control element via which, when at least one of the pushbuttons is actuated, a position of the associated valve body in the second valve position is secured and all other valve bodies that are already in the second valve position, and whose associated pushbutton is not actuated, are reset from the second valve position to the first valve position, wherein at least two of the pushbuttons can be actuated simultaneously, and when one of the at least two pushbuttons is again actuated, the associated valve body of the one of the at least two pushbuttons remains in the second valve position and the associated valve body of the other of the at least two pushbuttons is reset from the second valve position to the first valve position.

2. The showerhead or hand shower according to claim 1, further comprising at least one additional valve that is coupled to one of the plurality of valves and is controllable or actuated substantially simultaneously with it through its associated pushbutton.

3. The showerhead or hand shower according to claim 1, wherein the control element is configured to guide the plurality of valve bodies.

4. The showerhead or hand shower according to claim 1, wherein multiple fluid distribution chambers are provided in the showerhead and the inflow of at least one fluid per fluid distribution chamber is regulated via at least one of the plurality of valves.

5. The showerhead or hand shower according to claim 1, wherein each valve of the plurality of valves is in a closed position in the first valve position and is in a flow position in the second valve position.

6. The showerhead or hand shower according to claim 5, wherein there are "$2^x-1$" possibilities for activating different spray types or combinations of spray types for the plurality of valves and the associated pushbuttons.

7. The showerhead or hand shower according to claim 1, wherein the movable valve body of each valve is displaceable along a longitudinal axis thereof.

8. The showerhead or hand shower according to claim 1, wherein each respective movable valve body has a return spring, and wherein a movement of each respective movable valve body from the first valve position into the second takes place in opposition to a force of the respective return springs.

9. The showerhead or hand shower according to claim 1, wherein the movable valve body of each respective valve has a seal element provided thereon or the seal element is provided on a valve seat of each respective valve.

10. The showerhead or hand shower according to claim 1, wherein each movable valve body comprises a tappet and a seal body.

11. The showerhead or hand shower according to claim 1, wherein at least one gate for guiding at least one of the plurality of valve bodies is provided on the control element.

12. The showerhead or hand shower according to claim 1, wherein a guide element is provided on each of the plurality of valve bodies.

13. The showerhead or hand shower according to claim 12, wherein a peg or cone is provided as the guide element.

14. The showerhead or hand shower according to claim 1, wherein a rotatable gate disc or a translationally movable gate slide is provided as the control element.

15. The showerhead or hand shower according to claim 1, wherein a movement of the control element in opposition to a force of a return spring takes place when one of the plurality of valves is actuated.

16. The showerhead or hand shower according to claim 1, wherein the control element is configured as a locking element for the plurality of valve bodies in the first or second valve positions.

17. The showerhead or hand shower according to claim 1, wherein one or more receptacles for each of the plurality of valve bodies are provided on the control element, which receptacles define valve positions.

18. A method for selecting at least one spray type in a showerhead or hand shower with "x" (x>1) controllable valves and with multiple spray types, the method comprising:

associating at least one valve with each spray type, each of the "x" valves being independently controllable of the other valves and comprises a movable valve body via which at least a first and a second valve position are realized;

arranging, for each of the "x" valves, a pushbutton that displaces the associated movable valve body upon actuation; and actuating a plurality of the pushbuttons simultaneously to displace the movable valve bodies of the associated valves from the first valve position to the second valve position, wherein, when at least one of the plurality of pushbuttons is again actuated, the movable valve bodies associated with the at least one pushbutton remain in the second valve position and all other movable valve bodies whose associated pushbutton, out of the plurality of pushbuttons, is not actuated again, return to the first valve position, and wherein the first valve position is a closed position and the second valve position is a flow position.

19. The showerhead or hand shower according to claim 13, wherein the guide element is the peg and the peg protrudes from each movable valve body in a direction that is perpendicular to an axial direction of each movable valve body.

20. The showerhead or hand shower according to claim 12, wherein whether each of the valves is in the first valve position or the second valve position, the movable control element is in continuous direct contact with the guide element of each of the movable valve bodies.

21. The showerhead or hand shower according to claim 13, wherein the guide element is the cone that is provided at an end of each movable valve body.

22. The showerhead or hand shower according to claim 5, wherein each valve of the plurality of valves can be in the second valve position simultaneously.

23. The showerhead or hand shower according to claim 2, wherein the at least one additional valve is coupled to the one of the plurality of valves by a lever, a first end of the lever contacting the one of the plurality of valves and a second end of the lever contacting the at least one additional valve, such that when the one of the plurality of valves is displaced via actuation of the respective pushbutton, the one of the plurality of valves presses the first end of the lever in a first direction to cause the second end of the lever to displace the at least one additional valve in a second direction that is opposite to the first direction.

* * * * *